US005215015A

United States Patent [19]

Iida et al.

[11] Patent Number: 5,215,015

[45] Date of Patent: Jun. 1, 1993

[54] TRACK SYSTEM AND VEHICLE HAVING BOTH MAGNETIC AND AERODYNAMIC LEVITATION, WITH WINGS ON THE VEHICLE CARRYING THE WHOLE WEIGHT AT NORMAL OPERATING SPEEDS

[75] Inventors: Fumio Iida; Naofumi Tada, both of Hitachi, Japan

[73] Assignee: Hitachi, Ltd., Tokyo, Japan

[21] Appl. No.: 869,220

[22] Filed: Apr. 16, 1992

Related U.S. Application Data

[63] Continuation of Ser. No. 574,772, Aug. 20, 1990, abandoned.

[30] Foreign Application Priority Data

Sep. 14, 1989 [JP] Japan ..... 1-237064

[51] Int. Cl.[5] ..... B60L 13/06; B61B 13/08

[52] U.S. Cl. ..... 104/23.1; 104/281; 104/284; 104/293

[58] Field of Search ..... 104/23.1, 23.2, 282, 104/284 X, 285, 290, 293 X

[56] References Cited

U.S. PATENT DOCUMENTS

| | | | |
|---|---|---|---|
| 1,354,002 | 9/1920 | Reed | 104/23.1 |
| 2,976,820 | 3/1961 | Schaar | 104/23.1 X |
| 3,675,582 | 7/1972 | Girard et al. | 104/23.1 |
| 3,768,417 | 10/1973 | Thornton et al. | 104/282 |
| 3,780,667 | 12/1973 | Miericki et al. | 104/285 |
| 3,820,471 | 6/1974 | Maki et al. | 104/282 |
| 4,703,697 | 11/1987 | Bell | 104/23.1 |
| 4,766,358 | 8/1988 | Higuchi | 104/281 X |
| 4,913,059 | 4/1990 | Fujie et al. | 104/282 |
| 4,941,406 | 7/1990 | Lay | 104/23.1 |
| 4,969,401 | 11/1990 | Kolm | 104/284 |
| 5,033,391 | 7/1991 | Watanabe | 104/23.2 |

*Primary Examiner*—Robert J. Oberleitner
*Assistant Examiner*—S. Joseph Morano
*Attorney, Agent, or Firm*—Antonelli, Terry Stout & Kraus

[57] ABSTRACT

A track vehicle such as a Maglev train has a body with superconducting coils mounted thereon which superconducting coils interact with vertically extending coils on guideways of a track to generate a propulsive force. The vehicle runs on wheels at low speeds but at higher speeds the superconducting coils may interact with ground coils to generate a lifting force. In order to reduce or eliminate stresses between the superconducting coils and the vehicle body, the vehicle has one or more wings of airfoil shape which generate lift. That lift may be sufficient to support the whole of the weight of the vehicle, enabling the ground coils to be eliminated. Furthermore, the shape of the superconducting coils may be changed so that they supply more energy to propulsive effects. Preferably the angle of incidence of the wing(s) is variable, to permit the lift generated thereby to be varied. This variation in the angle of incidence may be controlled by a sensor detecting the height of the body above the track, to maintain that height constant.

30 Claims, 5 Drawing Sheets

Angle of Incidence.

TRACK SYSTEM AND VEHICLE HAVING BOTH MAGNETIC AND AERODYNAMIC LEVITATION, WITH WINGS ON THE VEHICLE CARRYING THE WHOLE WEIGHT AT NORMAL OPERATING SPEEDS

This application is a continuation of application Ser. No. 574,772 filed on Aug. 30, 1990, now abandoned.

BACKGROUND OF THE INVENTION

1. Field of the Invention

The present invention relates to a vehicle arranged for movement along a track, and also to a tracked vehicle system for such a vehicle.

2. Summary of the Prior Art

There is increasing interest in the design of a vehicle which is to be driven along the track making use of electromagnetic drive forces to lift and/or propel the vehicle along the track. Such vehicles are known as Maglev vehicles, and have the advantage that such vehicles are capable of reaching much higher speeds than ordinary track vehicles (e.g. about 500 km/hr) because there is no direct vehicle/track contact. Of course, for slow speeds, such a vehicle will have wheels which run on the track, but if the vehicle increases in speed, the magnetic effects predominate.

The development of Maglev vehicles has been linked to the development of superconducting magnets, because a Maglev vehicle needs to have at least one (usually many) superconducting magnets which interact with coils in the track to support and propel the vehicle. In general, the track will have normal conducting coils which, together with the superconducting magnet(s), generate a lifting force for supporting the vehicle clear of the track, and other coils which, again together with the superconducting coils, generate a propulsive force.

There have been a number of proposals for making use of aerodynamic effects on a Maglev vehicle. For example, in the article entitled "Development of Aerodynamic Brake of Maglev Vehicle for Emergency Use" by Koda et al. in International Conference Maglev '89 (July 1989), pages 281 to 286, there was proposed an aerodynamic brake for such a vehicle. The aerodynamic brake comprised one or more plates which were movable so as to move between a position in which they were generally flush with the body of the vehicle to a position in which they extended outwardly from it so as to increase the drag of the vehicle and therefore slow it down.

In JP-A-48-9416 there was proposed an arrangement in which flat fins extended along the length of the Maglev vehicle, the drag of those fins resisting pitching of the vehicle. Furthermore, in JP-A-48-9417 it was proposed that the Maglev vehicle had flat stabilizers which could be moved out from a position flush with the body of vehicle to a projecting position, in which projecting position they applied a lift to the part of the body to which they were attached, due to their angle of incidence with the direction of movement.

SUMMARY OF THE INVENTION

In the existing Maglev vehicles, when the vehicle is running at full speed, the whole of the weight of the vehicle is passed to the superconducting coils, since it is those coils which support the vehicle due to their magnetic interaction with the coils on the track. However, the total weight of the vehicle puts a great strain on the superconducting coils, and the inventors of the present application have discovered that this force may be sufficient to deform the coils and such deformation causes the coils to quench, i.e. to change from the superconducting state to the normal state. In the normal state, the forces generated by the coils are insufficient to support the vehicle, and therefore failure can occur, which could prove critical at the high speeds at which the vehicle may be operating, since wheels would not then be able to respond to the high speeds of the vehicle. Furthermore, the stresses applied to the superconducting coils will be at their greatest during acceleration and deceleration, particularly the high deceleration levels needed when emergency braking occurs. Thus, the lifting effect of the coils is most likely to fail in emergency situations, which is highly undesirable.

The present invention seeks to reduce the loading on the superconducting coils due to the weight of the vehicle, and proposes that one or more wings of airfoil shape are provided on the vehicle. The airfoil shape of the wings generates a lifting force, which at least partially supports the weight of the vehicle when the vehicle is moving at full speed. Therefore, the forces applied by the weight of the vehicle to the superconducting coils are reduced, and the risk of deformation (and quenching of the superconducting coils) is also reduced.

The airfoil shape of the wings of the present invention is highly important, and none of the proposals discussed above addressed this problem. Airfoils have a relatively low drag coefficient, as compared with the lift they generate, and thus are entirely different from the flat stabilizers disclosed in JP-A-48-9417 which will have a significant drag when they provide a lifting effect, since they are flat and not airfoil shaped.

There are two fundamental benefits provided by the present invention, which permit the design of the vehicle and the track system incorporating the vehicle to be improved. Firstly, although it is possible for the wing(s) to support only part of the weight of the vehicle, it is preferable for the number and shape of the wings to be chosen so that, at least at normal operating speed, substantially the whole of the weight of the vehicle is supported by the lifting force generated by the wings. Then, a magnetic lifting force is unnecessary and the lifting coils, normally placed horizontally on the track, can be eliminated. Since, for a practical Maglev system, a pair of lifting coils (one for each side of the vehicle) is required for every meter of track, it can be seen that the elimination of the lifting coils offers substantial cost advantages.

Secondly, since the superconducting coils do not need to generate a large lifting force and can generate more propulsive force, their shape may be re-designed. In existing superconducting coils, the coils are generally of linked (racetrack) shape, with the major axis of the loop extending horizontally so that that horizontal part interacts with the horizontal coils of the track to generate a lifting force. The coils are thus longer in the horizontal direction than the vertical direction. However, the present invention proposes that the coils be longer in the vertical direction than the horizontal direction, i.e. that they generate a large propulsive force relative to the lifting force. Therefore, for a given propulsive force, the energy input to the superconducting coils is reduced and a more efficient propulsion system is achieved.

In a further development, the present invention proposes that the angle of incidence of the wing(s), i.e. the inclination of the wing relative to the vehicle, is variable, as such variation varies the lifting force applied to the vehicle. If the vehicle then has a sensor for detecting its spacing from the track, the angle of incidence, and hence the lifting force, can be varied in dependence on that spacing to ensure that the vehicle moves at a uniform height. This effect may further be improved by providing a plurality of wings and a corresponding plurality of sensors, so that the spacing of the vehicle from the track may be made uniform at a plurality of locations, ensuring that the vehicle does not pitch. Such variation in angle of incidence may be achieved by rotating the whole of the wing about a horizontal axis, or by rotating only part of the wing about such an axis. Normally, for such variations in lifting force, only small changes in the angle of incidence are needed. However, if the means for changing the angle of incidence permits large changes in the angle, it is then possible for the wing also to act as an aerodynamic brake when necessary.

Also, since an airfoil wing generates a lifting force only when it is moving generally in one direction (the attack direction), the wing(s) of a vehicle according to the present invention may be rotatable about a vertical axis, to change their attack direction. Thus, the wings may be rotatable about 180°, to permit the generation of a lifting force when the direction of the vehicle is reversed.

BRIEF DESCRIPTION OF THE DRAWINGS

Embodiments of the present invention will now be described in detail, by way of example, with reference to the accompanying drawings in which:

FIG. 3(*b*) is a graph showing the relationship between the angle of incidence of the wing and lift and drag coefficients;

DETAILED DESCRIPTION

In the following description, the present invention will be described with reference to a Maglev train, although the present invention is not limited to such a vehicle only.

Figure 1:
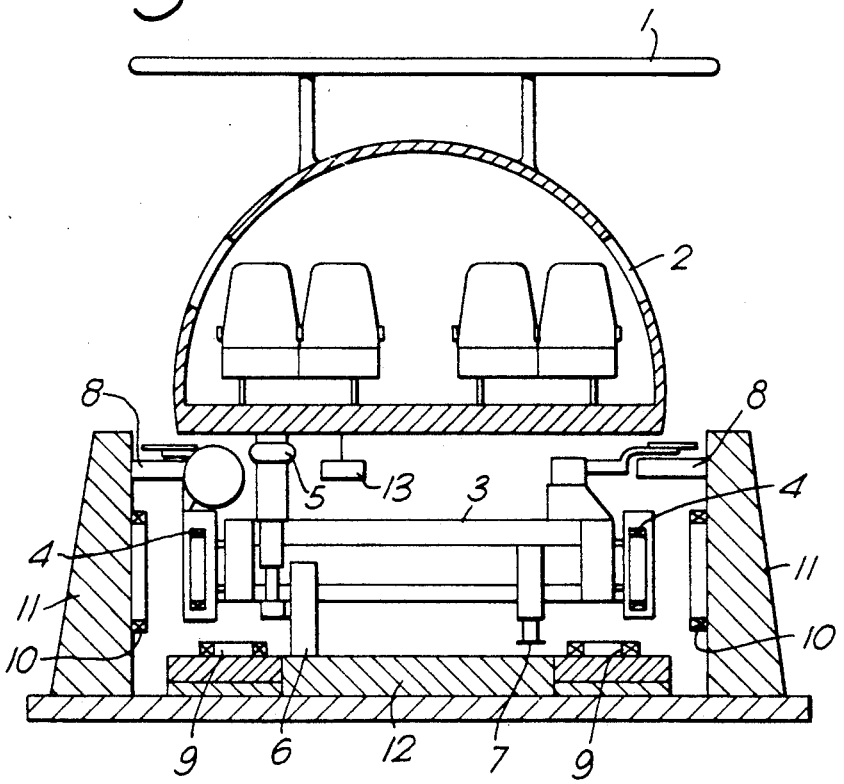
FIG. 1 is a cross-sectional view through a Maglev train being a first embodiment of the present invention.
Figure 2:
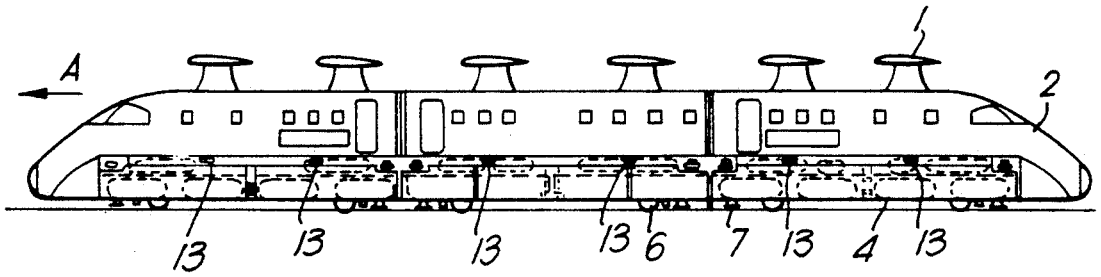
FIG. 2 shows a side view of the Maglev train of FIG. 1.

FIGS. 1 and 2 show a superconducting magnetic floating train (Maglev train) having a vehicle body 2 with one or more airfoil wings 1 to provide a lifting force for supporting partially or wholly the weight of the train so that the load on the superconducting coils 4 may be reduced to avoid quenching due to deformation of those coils. Unlike known Maglev trains, the lifting force is not generated wholly by the superconducting coils 4 but assisted by the lift generated by the airfoil wings 1 so that the strength of the supporting structure for the superconducting coils 4 is sufficient for the forces applied thereto, and hence deformation of the coils 4 is less likely, thereby increasing the reliability of the superconducting coils 4.

In FIG. 1, the general structure of the Maglev train is visible, with the body 2 of the train being connected to a chassis 3, which chassis 3 supports the superconducting coils 4. Preferably, the body 2 is connected to the chassis 3 via pneumatic springs 5 to increase the comfort of the people travelling in the body 2 of the Maglev train. At low speeds, lifting forces generated by the airfoil wing 1 and/or the superconducting coils 4 will be insufficient to support the vehicle, and therefore there are wheels 6 on the chassis 3 which support the weight of the Maglev train at low speeds. The chassis 3 may also have brakes 7.

The wheels 6 run on a track 12, and adjacent that track 12, and extending generally horizontally, are a plurality of ground coils 9, which ground coils 9 interact with the superconducting coils 4 to generate a lifting force for the vehicle. Furthermore, on either side of the track 12, there are guideways 11, which support generally vertically extending coils 10, which coils 10 interact with the superconducting coils 4 to generate a propulsive force for the vehicle. In the known systems, which are similar to the arrangements shown in FIG. 1 without the wing 1, the whole of the weight of the body 2 and the chassis 3 is, when the Maglev train is moving at normal speeds, supported by the interaction between the superconducting coils 4 and the ground coils 9. Additional guide wheels 8 may be provided on the chassis 3 which abut against the guideways 11 to prevent excessive lateral movement of the Maglev vehicle. FIG. 1 also shows a sensor 13, which can measure the separation of the superconducting coil 4 or the body 2 and the track 12, to control the height of the vehicle above the track 12 in a manner which will be described subsequently.

In FIG. 2 the airfoil shape of the wings 1 is more apparent, and it can be seen that they will generate a lift when the train is moving in a direction shown by arrow A. FIG. 2 also shows that a plurality of wings may be provided on the Maglev train, the wings 1 being spaced along the length of the Maglev to provide suitable support therefor. There may further be a sensor 13 associated with each wing 1.

A variety of configurations are possible for the airfoil wing 1 attached to the body 2 of the Maglev train of the present invention, such as in the embodiment shown in FIG. 1. If the lift and the drag generated by an airfoil wing 1 are designated as L and D, respectively, their values are each proportional to the density $\tau/g$ of the air, the square $u^2$ of the velocity u and the area S of the wing 1, as expressed by the following equations, in which letter g designates the acceleration due to gravity:

$$L = C_L \cdot \tau / 2g \cdot u^2 S \quad \text{(Eq.1)}$$

and $$D = C_D \cdot \tau / 2g \cdot u^2 S \quad \text{(Eq.2)}$$

Figure 3A:
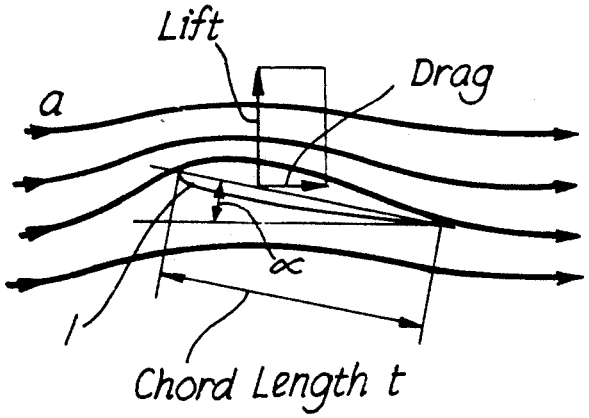
FIG. 3(*a*) shows a schematic view of the relationship between lift and drag of the wing of the embodiment of FIG. 1.
Figure 3B:
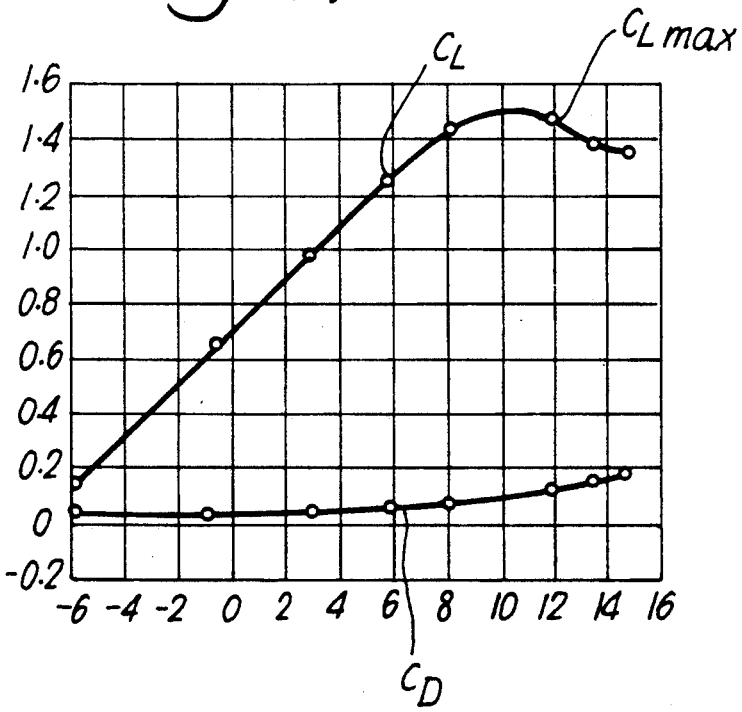

Here, coefficients $C_L$ and $C_D$ are dimensionless coefficients which depend on the shape of the wing 1 and are called the "lift coefficient" and the "drag coefficient", respectively. The lift coefficient $C_L$ and the drag coefficient $C_D$ each vary according to the angle of incidence $\alpha$ of the wing 1, as shown in FIG. 3(*b*). For a small angle of incidence $\alpha$, the lift coefficient $C_L$ increases generally linearly with an increase in the incidence angle $\alpha$ but begins to decrease abruptly after a maximum value $C_{Lmax}$ has been reached. The angle of incidence $\alpha$ corresponding to the value $C_{Lmax}$ is called the "stall angle". The drag coefficient $C_D$ initially increases slowly with an increase in the angle of incidence $\alpha$ but increases abruptly adjacent the stall angle. Thus, the drag of the Maglev train is expressed by the following equation:

$$D_t = C_{Dr}\tau/2g \cdot u^2 S \quad \text{(Eq. 3)}$$

In equation 3, the coefficient $C_{Dt}$ designates the total drag coefficient of the Maglev train. When running at a constant speed, the total drag $D_t$ is equal to the thrust which is given from the propelling/guiding ground coils.

This total drag $D_t$ is composed of the following drag factors:

Total Drag

A) Drag of Airfoil Wing (i) Drag of Two-Dimensional Wing (ii) Induced Drag (due to Wing Ends)

B) Drag due to Train Body.

Hence, the total drag is expressed by using a section drag $D_z$ and an induction drag $D_1$ in the following form:

$$D_t = D_z + D_1 = (C_{DZ} + C_{D1}) \cdot \tau/2g \cdot u^2 St \quad \text{(Eq. 4)}$$

In this equation the induction drag coefficient $C_{D1}$ is theoretically expressed by the following equation:

$$C_{D1} = K/\pi\lambda \cdot C_L^2 \quad \text{(Eq. 5)}$$

The symbol $\lambda$ designates the ratio b/t of the wing width to the chord length t (see FIG. 3a), and letter K designates a constant which has an ideal value of 1 but has a practical value between 1 and 2.

If equation 5 is substituted into equation 4, the total drag $D_t$ is determined by the following:

$$D_t = (C_{DZ} + K/\pi\lambda \cdot C_L^2) \cdot \tau/2g \cdot u^2 S \quad \text{(Eq. 6)}$$

The lift and total drag which act on the Maglev train are calculated by using equations 1 and 6. The lift and the total drag are calculated and plotted in FIG. 4, assuming that the total weight (i.e. the weight of the car body + the weight of the passengers) of each section of the train is 30 tons and that the area of the wings of each section is $S = 18\ m^2$. In these calculations: the specific gravity $\tau$ of air is $1.226\ kg/m^3$; the acceleration due to gravity g is 9.81; the lift coefficient $C_L$ is 1.4; the constant K is 1.5; the wing aspect ratio $\lambda$ is $6/\pi = 3$; and the drag coefficient $C_{DZ}$ is 0.03.

The lift L and the total drag $D_t$ are calculated by equations 1 and 6, respectively.

At a speed of 500 km/hr, it is found that the lift is 30 tons and that the total drag is 7.5 tons. In these calculations, the area of the airfoil wing 1 is limited to be smaller than the projection area of the roof of the Maglev train on the ground. In the calculations, moreover, the lift coefficient, i.e., the angle of incidence $\alpha$ is constant and set to 10°. Thus, a sufficient lift can be attained by attaching the airfoil wing 1 to the body 2 of the Maglev train.

The above analysis has assumed that the angle incidence $\alpha$ of the wing 1 is fixed. However, it can readily be seen from FIG. 3(*b*) that the lift can be varied by varying this angle and this may be used to ensure that the Maglev train runs smoothly. Thus, for example, if the spacing of the vehicle from the track is detected by the sensor 13, that sensor may generate a signal which controls the angle of the airfoil wing 1.

Figure 5:
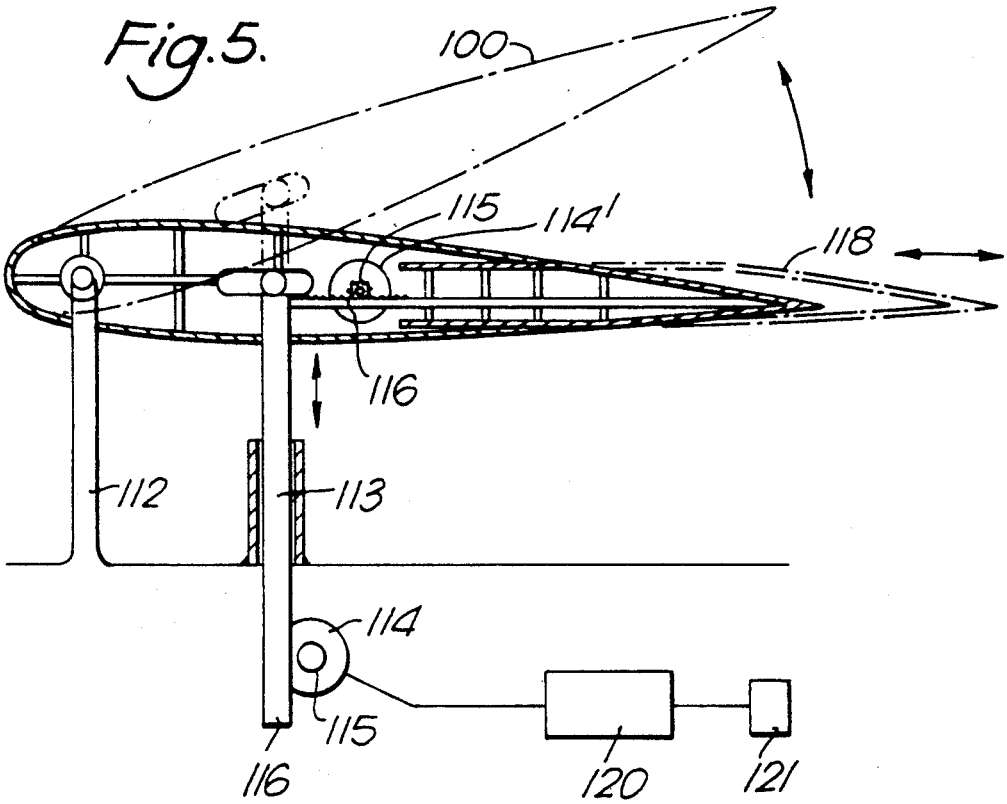
FIG. 5 shows a first arrangement which may be used in the embodiment of FIG. 1 for varying the angle of incidence and the area of the airfoil wing of the Maglev train.
Figure 6:
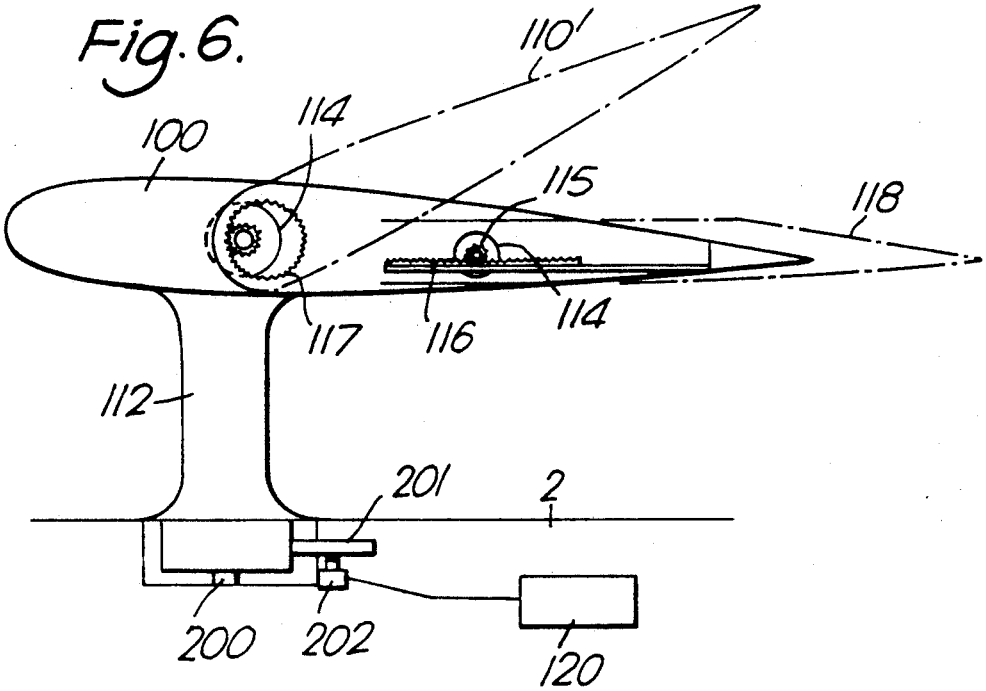
FIG. 6 shows a second arrangement for varying the angle of incidence and the area of the airfoil wing of the Maglev train of FIG. 1.

FIGS. 5 and 6 are partial sections showing arrangements of a mechanism for changing the angle and area of the airfoil wing which may be used in embodiments of the present invention. A variety of mechanisms can be conceived to change the angle and area of the airfoil wing. Considering first changes in that angle of incidence $\alpha$ it is possible to move the whole of the wing 1, as shown in FIG. 5, or to move only a part of the wing, as shown in FIG. 6. In FIG. 5, an airfoil wing 100 is mounted on a vehicle, e.g. the body 2 of the Maglev train of FIGS. 1 and 2 by a support column 112. The angle of incidence $\alpha$ of that wing 100 is changed by turning a pinion 115 driven by a motor 114. The motor 114 is mounted on an upper part of the body of the vehicle or in the wing 100, to drive a rack 116 or a pinion 115. The control signal to the motor 114 is determined so as to move the wing 100 to the optimum angle by a signal from a sensor 121, via control means 120. That sensor 121 may derive its signal from a height sensor 13, as in FIG. 1, or from a speed sensor which measures the speed of the vehicle. In a similar way, the running speed or the spacing of the train from the track may be used, on the basis of suitable calculations, to determine the optimum area of the airfoil wing 100 so that the output of the control means 120 is fed to a motor 114' to project or retract an auxiliary wing 118 thereby to change the effective area of the wing 100.

In FIG. 6, part of the wing 100 is stationary, and that part is fixed to the body of the vehicle by the support column 112. Only a part 110' of the wing 100 is movable and is actuated by a motor 114 in a similar way to that described with reference to FIG. 5. Furthermore, when the area of the wing 100 is to be changed, an auxiliary wing 118 is slid out of or into the inside of the floating wing 100 to change the wing area. It can be seen that, apart from the fact that only part of the wing 100 is moved in FIG. 6, the mechanism for changing the angle of incidence is the same for both FIGS. 5 and 6.

At a certain running speed or higher, moreover, the height of the body 2 of the vehicle from the track 12 may be measured by e.g. the sensor 13 (see FIG. 1) to change the angle and area of the floating wing thereby to control the lift so that the body can be held at a constant level. If the Maglev train must come to a sudden stop, on the other hand, the wing may have its angle changed with respect to the body 2 to play the role of a brake so as to establish a high braking force. The mechanism for changing the angle and area of the floating wing may be exemplified by a hydraulic cylinder, for example, in addition or as an alternative to the motor shown in FIGS. 5 and 6.

The above description has referred to the control of one wing by a single sensor. In practice, each wing 1 of the Maglev train of FIG. 2 will have a separate sensor 13, controlling a corresponding wing 1 as shown in FIG. 2. This is important because, since the wings are spaced along the length of the train, it is possible for pitching of the train to be eliminated by changing the angle of one wing relative to another.

As was mentioned earlier, the wings 1 will provide a lifting force to the Maglev train shown in FIG. 2, when that train is moving in the direction of arrow A. When the train has to travel in the opposite direction for a return journey, it would be possible to rotate the whole of the train, but this is inefficient. Instead, means may be provided for rotating the wings 1 about a generally vertical axis, so that the direction of attack (i.e. the direction in which the wing must move in order to generate lift) is changed. Thus, if the Maglev train shown in FIG. 2 is to move in the opposite direction to the arrow A, the wings 1 can then be rotated through 180° to provide suitable lifts.

A mechanism for achieving this is shown in FIG. 6, in which the support column 112 of the wing 100 is mounted on the body 2 of the vehicle, via a generally vertically extending axis defined by shaft 200. Rotation of the support column 112 about that shaft 200 changes the direction of attack of the wing 100. That rotation is controlled by a drive force applied e.g. from a drive wheel 201 controlled by a motor 202. The wheel 201 engages the base of the support column 112 to cause it to rotate. The motor 202 may be controlled by the control means 120.

Figure 4:
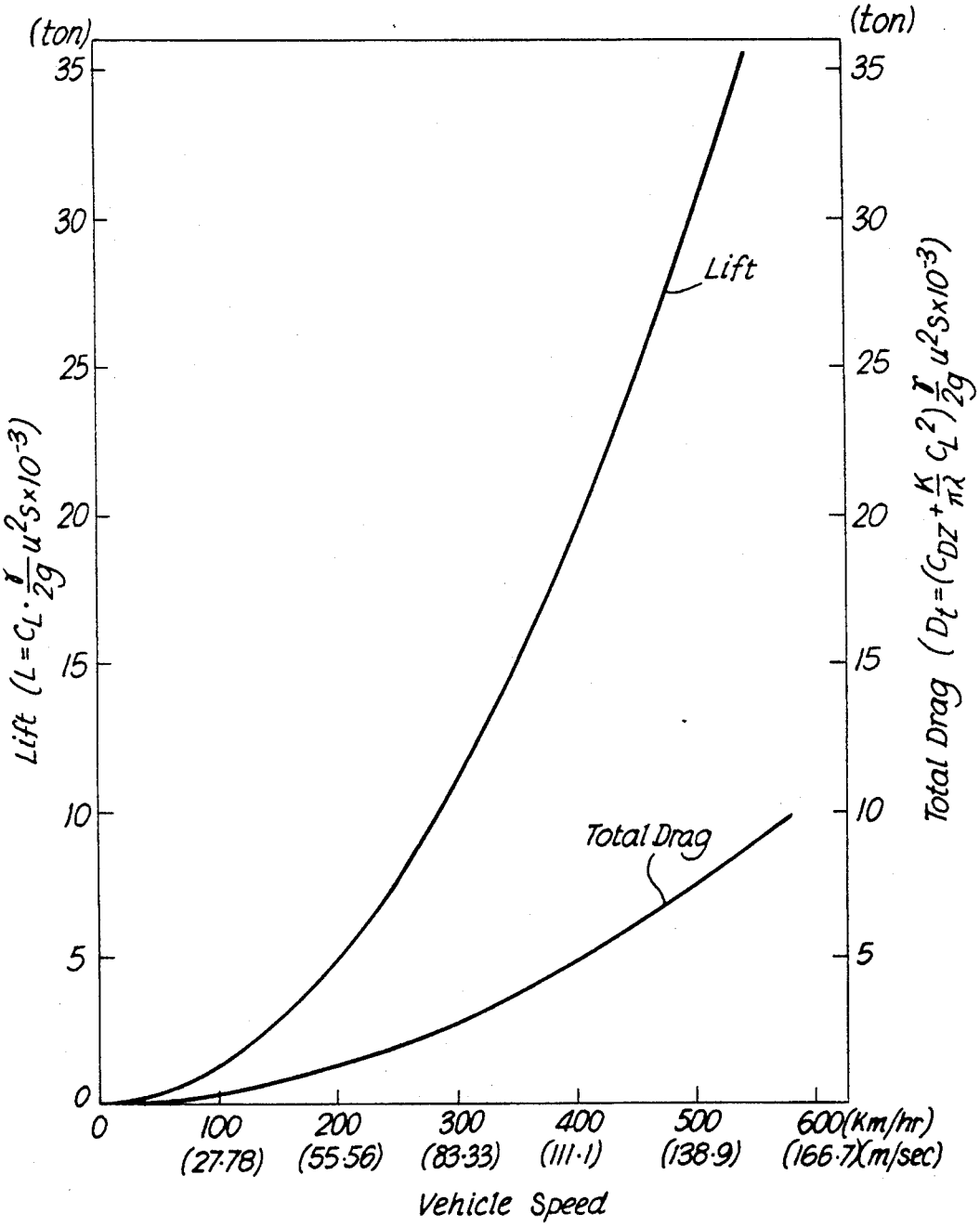
FIG. 4 is a graph showing the relationship between the speed of a vehicle and the lift and drag.
Figure 7:
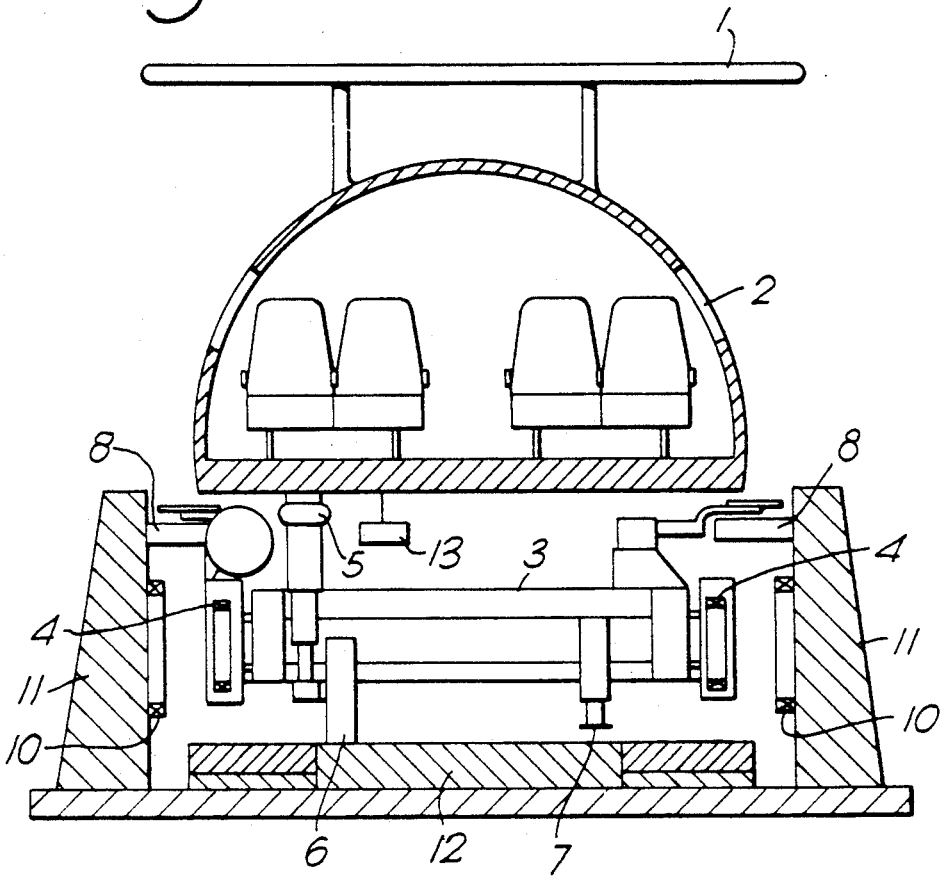
FIG. 7 shows a second embodiment of the present invention.

Thus, depending on the angle of incidence $\alpha$, the airfoil wings 1 may generate a lifting force on the Maglev train. As this force increases, the amount of lifting force which must be generated between the superconducting coils 4 and the ground coils 9 is reduced. If the wings 1 generate sufficient lifting force, at normal operational speeds of the Maglev train, the ground coils 9 can be completely eliminated, as in the embodiment shown in FIG. 7. This embodiment is the same as that of FIG. 1, except for the omission of the ground coils 9. At low speeds, the weight of the Maglev train is supported by the wheels 6, and a propulsive force is generated between the superconducting coils 4 and the vertically extending coils 10. As the Maglev train increases in speed, the lift generated by the wings 1 also increases, as shown by FIG. 4, and this lifting force may designed to be sufficiently large to lift the Maglev train, thus lifting the wheels 6 clear of the ground and allowing higher speeds to be achieved. Again, control is achieved by changing the angle of incidence $\alpha$ of the wings 1.

This embodiment has the advantage that the ground coils 9 are eliminated, thereby reducing the cost of the track.

In existing Maglev trains, the superconducting coils must generate sufficient force to lift the train, and this determines their shape. The normal coils are looped in a racetrack shape, and in order to generate sufficient lifting force, it is necessary that the length of that loop in a horizontal direction is greater than the length in the vertical direction. It is the horizontal part of the loop which interacts with the ground coils to generate the lifting force, and the vertical part which interacts with the coils which generate the propulsive force. If the lifting force needed between the superconducting coils and the ground coils is reduced or eliminated, e.g. by using an airfoil wing according to the present invention, then the shape of the coils can be changed.

Figure 8:
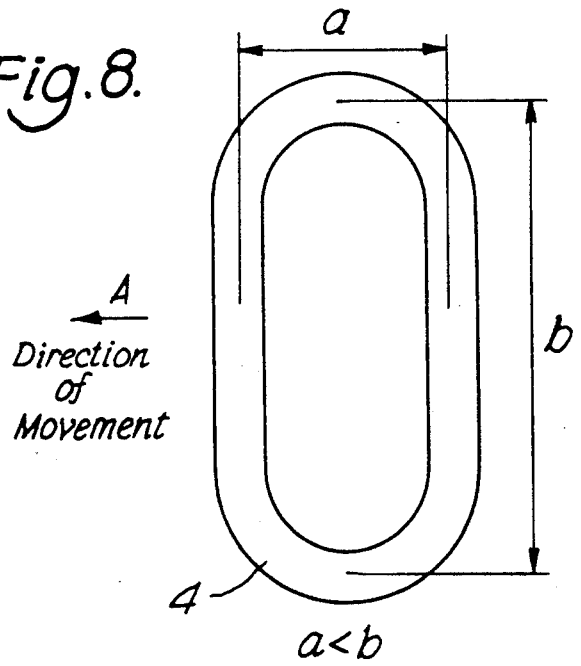
FIG. 8 shows the shape of a superconducting coil which may be used with the present invention.

FIG. 8 shows the configuration of a superconducting coil 4 which may be used in the present invention. As can be seen, if the coil 4 is mounted on a vehicle moving in the direction of arrow A (generally horizontal), then the horizontal dimension a of the coil may be made less than the vertical direction b. In existing coils, the relationship is necessarily the other way round.

Thus, in conclusion, the present invention proposes that one or more airfoil wings be provided on a vehicle, which vehicle is to be driven by magnetic interaction between superconducting coils on the vehicle and coils on a track, and then the airfoil wing may generate sufficient force to reduce the stresses on the superconducting coils, reducing the risk of failure of those coils. Hence, a vehicle operating in accordance with the present invention has increased efficiency and safety. By changing the angle of incidence of the airfoil wing, the amount of lift can be varied to control the height of the vehicle above the track, and, if sufficient variation is permitted, to allow the airfoil wing to act as an aerodynamic brake. Furthermore, the present invention proposes that the shape of the superconducting coils be changed so that their vertical length (generating the propulsive force) is greater than the horizontal length (generating the lifting force) to increase the drive efficiency of the vehicle.

What is claimed is:

1. A vehicle arranged for movement on a track, said vehicle comprising:

a body;

at least one superconducting coil on said body for generating a propulsive force for said vehicle relative to said track; and quenching preventing means for preventing quenching of said at least one superconducting coil due to a whole weight of said vehicle being applied thereto, said quenching preventing means including at least one wing of airfoil shape on said body for generating a lifting force for supporting the whole weight of said vehicle, thereby causing said vehicle to float.

2. A vehicle according to claim 1, wherein said at least one wing has an angle of incidence relative to said body, and said vehicle includes means for varying said angle of incidence.

3. A vehicle according to claim 2, further comprising:

at least one sensor on said body for detecting the spacing of said body relative to said track; and means for controlling said means for varying said angle of incidence in dependence on said spacing.

4. A vehicle according to claim 2, wherein said means for varying said angle of incidence is arranged to move substantially the whole of said at least one wing.

5. A vehicle according to claim 2, wherein said means for varying said angle of incidence is arranged to move only a part of said at least one wing.

6. A vehicle according to claim 1, having means for varying the area of said at least one wing.

7. A vehicle according to claim 1, wherein said body has a top and a bottom relative to said track, and said at least one wing is located on the top of said body.

8. A vehicle according to claim 1, further comprising means for rotating said at least one wing about a substantially vertical axis, thereby to change the direction of attack of said at least one wing.

9. A vehicle arranged for movement on a track, said vehicle comprising:

a body;

at least one superconducting coil on said body for generating a propulsive force for said vehicle relative to said track; and at least one wing of airfoil shape on said body for generating a lifting force for supporting a whole weight of said vehicle, thereby causing said vehicle to float;

wherein said at least one superconducting coil is formed in the shape of a loop disposed in a substantially vertical plane, and a dimension of said loop extending in a substantially vertical direction is greater than a dimension of said loop extending in a substantially horizontal direction.

10. A vehicle according to claim 9, wherein said at least one superconducting coil is disposed only at a side of said body of said vehicle.

11. A vehicle arranged for movement on a track, said vehicle comprising:

a body;

at least one superconducting coil on said body for generating a propulsive force for said vehicle relative to said track; and quenching preventing means for preventing quenching of said at least one superconducting coil due to a whole weight of said vehicle being applied thereto, said quenching preventing means including a plurality of wings of airfoil shape on said body for generating a lifting force for supporting the whole weight of said vehicle, thereby causing said vehicle to float.

12. A vehicle according to claim 11, wherein said body is elongate and said plurality of wings are spaced apart along said body.

13. A vehicle according to claim 11, wherein each of said plurality of wings has a corresponding angle of incidence relative to said body, and said vehicle further includes:

means for varying the angle of incidence of each of said plurality of wings;

a plurality of sensors spaced apart on said body corresponding to said plurality of wings, each of said sensors being arranged to detect the spacing of a part of said body adjacent each of said sensors relative to said track; and means for controlling said means for varying said angle of incidence of each of said plurality of wings on the basis of the spacing detected by the corresponding sensor.

14. A tracked vehicle system comprising:

a track having a plurality of track coils; and a vehicle arranged to move on said track, said vehicle comprising:

a body;

at least one superconducting coil on said body for generating a propulsive force for said vehicle relative to said track; and quenching preventing means for preventing quenching of said at least one superconducting coil due to a whole weight of said vehicle being applied thereto, said quenching preventing means including at least one wing of airfoil shape on said body for generating a lifting force for supporting the whole weight of said vehicle, thereby causing said vehicle to float.

15. A system according to claim 14, wherein said track coils define first planes, and all of said first planes are generally vertical.

16. A system according to claim 14, wherein the vehicle is arranged to move on said track in a predetermined direction, and said at least one superconducting coil and said track coils are arranged to interact to generate a force in said predetermined direction only.

17. A system according to claim 14, wherein said at least one wing has an angle of incidence relative to said body, and said vehicle includes means for varying said angle of incidence.

18. A system according to claim 17, further comprising:

at least one sensor on said body for detecting the spacing of said body relative to said track; and means for controlling said means for varying said angle of incidence in dependence on said spacing.

19. A system according to claim 14, wherein said body has a top and a bottom relative to said track, and said at least one wing is located on the top of said body.

20. A tracked vehicle system according to claim 14, wherein said at least one superconducting coil is disposed only at a side of said body of said vehicle.

21. A tracked vehicle system comprising:

a track having a plurality of track coils; and a vehicle arranged to move on said track, said vehicle comprising:

at least one superconducting coil on said body for generating a propulsive force for said vehicle relative to said track;

said plurality of track coils comprising substantially vertically extending coils disposed adjacent to said track, said vertically extending coils interacting with said at least one superconducting coil to generate the propulsive force for said vehicle; and quenching preventing means for preventing quenching of said at least one superconducting coil due to a whole weight of said vehicle being applied thereto, said quenching preventing means including at least one wing of airfoil shape on said body for generating a lifting force for supporting the whole weight of said vehicle, thereby causing said vehicle to float.

22. A tracked vehicle system according to claim 21, wherein said at least one wing has an angle of incidence relative to said body, and said vehicle includes means for varying said angle of incidence.

23. A tracked vehicle system comprising:

a track having a plurality of track coils; and a vehicle arranged to move on said track, said vehicle comprising:

a body;

at least one superconducting coil on said body for generating a propulsive force for said vehicle relative to said track and for generating a lifting force for supporting a portion of a whole weight of said vehicle;

said plurality of track coils comprising substantially horizontally extending ground coils disposed on said track and substantially vertically extending coils disposed adjacent to said track, said horizontally extending ground coils interacting with said at least one superconducting coil to generate the lifting force for supporting the portion of the whole weight of said vehicle, said vertically extending coils interacting with said at least one superconducting coil to generate the propulsive force for said vehicle; and at least one wing of airfoil shape on said body for generating a lifting force for supporting substantially the whole weight of said vehicle, wherein the lifting force for supporting the portion of the whole weight of said vehicle and the lifting force for supporting substantially the whole weight of said vehicle combine to provide a total lifting force for supporting the whole weight of said vehicle, thereby causing said vehicle to float.

24. A tracked vehicle system according to claim 23, wherein said at least one wing has an angle of incidence relative to said body, and said vehicle includes means for varying said angle of incidence.

25. A tracked vehicle system according to claim 23, further comprising two guideways respectively disposed on both sides of said track, wherein said vertically extending coils are disposed on said guideways, and wherein said at least one superconducting coil is formed in the shape of a loop disposed in a substantially vertical plane, and a dimension of said loop extending in a substantially vertical direction is greater than a dimension of said loop extending in a substantially horizontal direction.

26. A vehicle arranged for movement on a track, said vehicle comprising:

a body;

at least one superconducting coil on said body for generating a propulsive force for said vehicle relative to said track; and at least one wing of airfoil shape on said body for generating a lifting force for supporting a whole weight of said vehicle, thereby causing said vehicle to float;

wherein said at least one superconducting coil also generates a lifting force for supporting a portion of the whole weight of said vehicle when said vehicle is moving at a speed less than a normal operating speed, and wherein said at least one wing generates the lifting force for supporting the whole weight of said vehicle when said vehicle is moving at the normal operating speed.

27. A vehicle arranged for movement on a track, said vehicle comprising:

a body;

at least one superconducting coil on said body for generating a propulsive force for said vehicle relative to said track; and a plurality of wings of airfoil shape on said body for generating a lifting force for supporting a whole weight of said vehicle, thereby causing said vehicle to float;

wherein said at least one superconducting coil also generates a lifting force for supporting a portion of the whole weight of said vehicle when said vehicle is moving at a speed less than a normal operating speed, and wherein said plurality of wings generate the lifting force for supporting the whole weight of said vehicle when said vehicle is moving at the normal operating speed.

28. A tracked vehicle system comprising:

a track having a plurality of track coils; and a vehicle arranged to move on said track, said vehicle comprising:

a body;

at least one superconducting coil on said body for generating a propulsive force for said vehicle relative to said track; and at least one wing of airfoil shape on said body for generating a lifting force for supporting a whole weight of said vehicle, thereby causing said vehicle to float;

wherein said at least one superconducting coil also generates a lifting force for supporting a portion of the whole weight of said vehicle when said vehicle is moving at a speed less than a normal operating speed, and wherein said at least one wing generates the lifting force for supporting the whole weight of said vehicle when said vehicle is moving at the normal operating speed.

29. A tracked vehicle system comprising:

a track having a plurality of track coils; and a vehicle arranged to move on said track, said vehicle comprising:

at least one superconducting coil on said body for generating a propulsive force for said vehicle relative to said track;

said plurality of track coils comprising substantially vertically extending coils disposed adjacent to said track, said vertically extending coils interacting with said at least one superconducting coil to generate the propulsive force for said vehicle; and at least one wing of airfoil shape on said body for generating a lifting force for supporting a whole weight of said vehicle, thereby causing said vehicle to float;

wherein said at least one superconducting coil also generates a lifting force for supporting a portion of the whole weight of said vehicle when said vehicle is moving at a speed less than a normal operating speed, wherein said plurality of track coils further comprise substantially horizontally extending ground coils disposed on said track, said horizontally extending ground coils interacting with said at least one superconducting coil to generate the lifting force for supporting the portion of the whole weight of said vehicle when said vehicle is moving at less than the normal operating speed, and wherein said at least one wing generates the lifting force for supporting the whole weight of said vehicle when said vehicle is moving at the normal operating speed.

30. A tracked vehicle system comprising:

a track having a plurality of track coils; and a vehicle arranged to move on said track, said vehicle comprising:

at least one superconducting coil on said body for generating a propulsive force for said vehicle relative to said track;

said plurality of track coils comprising substantially vertically extending coils disposed adjacent to said track, said vertically extending coils interacting with said at least one superconducting coil to generate the propulsive force for said vehicle;

at least one wing of airfoil shape on said body for generating a lifting force for supporting a whole weight of said vehicle, thereby causing said vehicle to float; and two guideways respectively disposed on both sides of said track, wherein said vertically extending coils are disposed on said guideways, and wherein said at least one superconducting coil is formed in the shape of a loop disposed in a substantially vertical plane, and a dimension of said loop extending in a substantially vertical direction is greater than a dimension of said loop extending in a substantially horizontal direction.

* * * * *